United States Patent [19]

Knox

[11] 4,320,546

[45] Mar. 23, 1982

[54] SURFBOARD

[76] Inventor: Carleton R. Knox, 4130 Harbor Dr., Carlsbad, Calif. 92008

[21] Appl. No.: 59,999

[22] Filed: Jul. 23, 1979

[51] Int. Cl.[3] ..... A63C 15/00

[52] U.S. Cl. ..... 441/74; 114/274; 441/79

[58] Field of Search ..... 9/310 B, 310 E; 114/274, 280

[56] References Cited

U.S. PATENT DOCUMENTS

| | | | |
|---|---|---|---|
| 2,081,868 | 5/1937 | Hampden | 114/274 |
| 2,751,612 | 6/1956 | Shepard | 9/310 B |
| 3,747,138 | 7/1973 | Morgan | 9/310 E |
| 3,797,434 | 3/1974 | Matthews | 114/280 |
| 4,044,416 | 8/1977 | Brewer et al. | 9/310 E |

FOREIGN PATENT DOCUMENTS

| | | | |
|---|---|---|---|
| 7709446 | 7/1977 | Fed. Rep. of Germany | 9/310 E |
| 113242 | 4/1968 | Norway | 114/280 |

*Primary Examiner*—George E. A. Halvosa
*Attorney, Agent, or Firm*—Knox & Knox

[57] ABSTRACT

A surfboard with a fin is developed to counteract the tendency for skegs or fins to "pop out" especially when the surfer "walks the nose" of the surfboard or rides high on a wave. The fin has a pair of opposed wing hydrofoils extending laterally from an approximately mid-point position on a vertical hydrofoil having a forwardly arcuate relieved portion above the wing hydrofoils, a downwardly-rearwardly swept leading edge and a rearwardly-upwardly swept trailing edge terminating at the confluence of the rear edges of the wing hydrofoils.

4 Claims, 4 Drawing Figures

FIG. 1
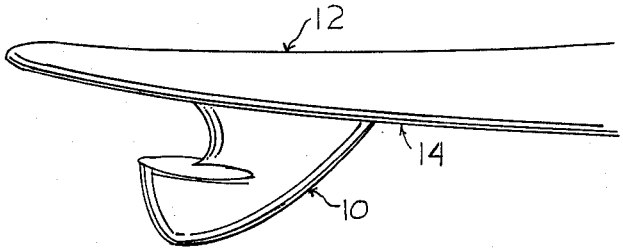
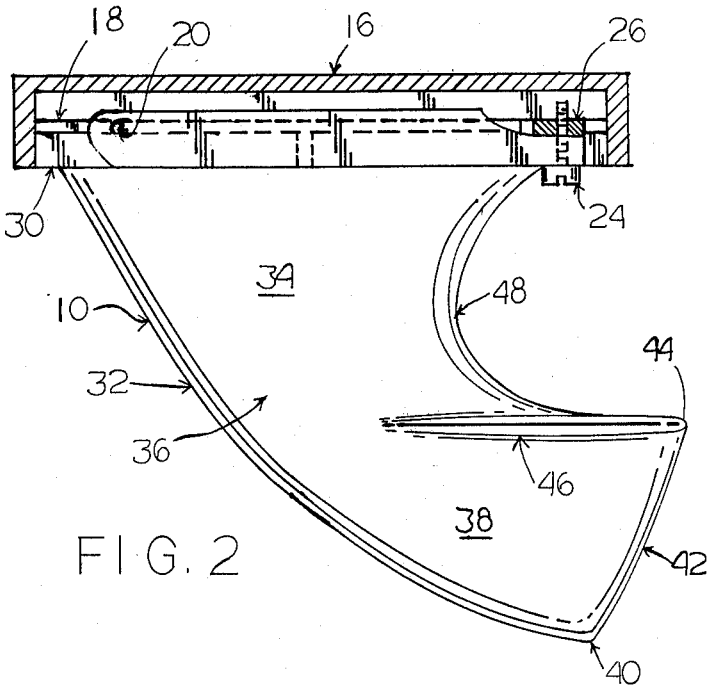
FIG. 2
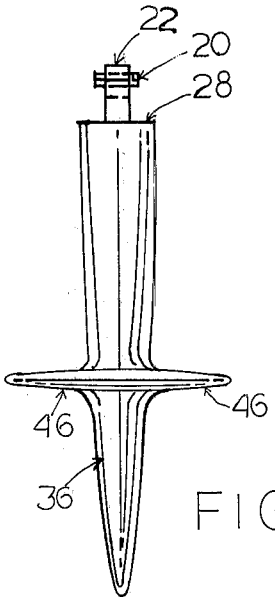
FIG. 3
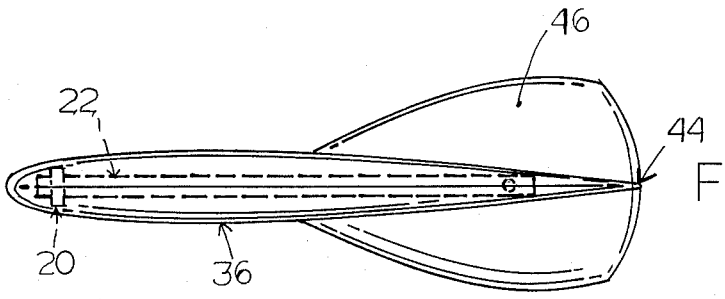
FIG. 4

SURFBOARD

BACKGROUND OF THE INVENTION

The present invention is related to water planing devices herein generally referred to a surfboard and particularly to a surfboard having a fin which stabilizes the surfboard against "pearling" due to the tail becoming airborne and the fin popping out of the water. Stabilized keels have been developed for water skis and motorized small sport water craft such as disclosed in U.S. Pat. Nos. 2,274,200 and 3,964,417, the technology therein being primarily concerned with maintaining the ski or other watercraft in upright position and in lessening unwanted cavitation effects which become material when the ski or other vehicle is pulled or otherwise power propelled. Another United States patent, U.S. Pat. No. 3,747,138, discloses hydrofoils designed "to support at least a portion of the surfboard above the surface of the water" with strictly horizontal hydrofoils on the lower extremities of struts, that is, this prior art invention is related to means to provide extreme lift or hydroplaning action, almost the reverse function to that sought by applicant.

SUMMARY OF THE INVENTION

The invention comprises a surfboard having a planing hull and a unique fin construction characterized by a downwardly-rearwardly swept leading edge combined with a trailing edge arcuately relieved in the upper portion thereof after the fashion of rudders for anti-cavitation effects, with wing hydrofoils formed symmetrically of the vertical hydrofoil just below the relieved portion thereof, these wing hydrofoils having their greatest span dimension near the trailing edges thereof. An important feature is the upwardly-rearwardly inclination of the wing hydrofoils, as disposed in use, to provide negative hydrodynamic lift to restrain the fin from popping out, that is, to prevent the tail end of the surfboard from becoming airborne especially when the surfer moves forward of the surfboard or attempts to "hang ten". Since most surfboards have an upwardly inclined undersurface near the tail the wing hydrofoils may be substantially parallel in a fore and aft direction with the undersurface and/or a fin box thereon, in order to achieve the abovementioned negative lift. The wing hydrofoils optimize laminar flow adjacent said undersurface of the tail.

BRIEF DESCRIPTION OF THE DRAWING

FIG. 1 is a perspective view of the tail portion of a surfboard with the claimed invention incorporated therein, and this figure illustrates the negative angle of the wing hydrofoils as disposed in use;

FIG. 2 is a side elevation of the fin as installed in a fin box, the latter being indicated in section;

FIG. 3 is a rear elevational view of the fin as viewed from the right hand side of FIG. 2, with the fin box removed;

FIG. 4 is a bottom plan view of the fin.

DESCRIPTION OF A PREFERRED EMBODIMENT

Referring now to the drawing, wherein like numerals refer to like or identical parts and portions throughout the different views, the fin as a whole is indicated by the numeral 10 and the tail of a surfboard is fragmentarily illustrated at 12.

Although a surfboard in use is notoriously unsteady, the terminology used herein to describe the surfboard and fin will reflect a stipulation that the surfboard be considered as substantially horizontal and the underside of the tail, as illustrated in FIG. 2, is inclined downwardly toward the right. The fin 10 could conceivably be otherwise attached or formed but the usual fin box 16 attachment means is illustrated in FIG. 2, this fin box conforming to the downwardly inclined undersurface, this inclination being an indirectly achieved but important consideration in the functionality of the wing hydrofoils 46 which will be described below.

The fin box 16, not claimed herein as novel, has opposed longitudinal slots 18 to receive a cross pin 20 in a camelback tongue 22 on the top of the fin 10. The tongue 22 is locked in place by a head bolt 24 inserted through an end portion of said tongue into a cross piece slider 26, all according to well known practice in removable attachment of fins. The shoulders 28 formed bilaterally of the tongue 22 abut the lower edges 30 of the sides of the fin box 16.

Coming now to the fin 10, it will be noted that the leading edge 32 thereof extends downwardly-rearwardly from the upper portion 34 of the vertical hydrofoil generally indicated by the numeral 36, through the lower portion 38 of the vertical hydrofoil 36 to the tip 40 thereof. All exposed edges of the fin 10 are gently faired for improved hydrodynamic performance. The trailing edge 42 of said lower portion 38 extends upwardly-rearwardly to the point of confluence 44 with the aft ends of the wing hydrofoils 46.

The wing hydrofoils 46 extend normal to and symmetrically bilaterally of the vertical hydrofoil 36 and in use are slightly upwardly-rearwardly inclined. This inclination is required to provide a negative hydrodynamic lift component in the tail of the surfboard during forward movement, and while achievable otherwise obviously is most simply achieved as illustrated in FIG. 1 by wing hydrofoils 46 parallel to the shoulders 28 and fin box 16, because the latter is mounted flush with the ordinarily upwardly-rearwardly inclined undersurface 14 of the tail portion 12 of the surfboard. Of course, the negative pitch of the wing hydrofoils is relied upon in keeping the fin from riding up which would result in the tail portion 12 becoming airborne and the surfboard becoming unmanageable. There are other advantages achieved, namely, the wing hydrofoils provide a positive effective lift to the surfboard when the latter is relatively stationary in the water as when the surfer is boarding or just taking off on a wave, making such a maneuver easier and faster, and a desirable laminar flow on the underside of the tail section is accentuated by the baffle action of the wing hydrofoils especially in "white water", all without materially adding to the drag. In connection with the question of drag it will be noted that the upper portion 34 is arcuately forwardly relieved as at 48, on the aft edge, that is, between a point approximately at the center of the wing hydrofoils 46 and the rear ends of the shoulders 28. This relief at 48 incidentally permits easy access to the head bolt 24 but, more importantly abets undivided laminar flow behind the upper portion 34 and the relieved trailing edge at 48 and on the underside of the tail of the surfboard.

All the above disclosed features co-operate toward stability of the surfboard, enabling easier taking off, providing an assured repetitive performance of the surfboard, and enabling a surfer to "walk the nose" sooner and stay there longer.

What I claim as new and desire to secure by Letters Patent is:

1. A surfboard comprising:

(a) an elongated surfboard planing hull having a tail end portion;

(b) a fin fixed on the underside surface of said tail end portion and comprising a vertical hydrofoil having a rearwardly-downwardly extending leading edge and an arcuately forwardly relieved portion in the upper part only of the trailing edge portion of the vertical hydrofoil, the lower part of said trailing edge portion being forwardly-downwardly swept; and (c) wing hydrofoils fixed on and extending only rearwardly from a mid-portion of said vertical hydrofoil and extending bilaterally thereof to stabilize the surfboard when a surfer is taking off on a wave and to enhance laminar flow between said wing hydrofoils and said underside surface of the tail end portion and to produce a negative lift component in the tail end portion during forward movement of the surfboard in the water, said underside surface of said tail end portion of the surfboard being upwardly-rearwardly inclined and said wing hydrofoils being generally parallel thereto, said wing hydrofoils being substantially at the level of the bottom of said relieved portion, thus furthering said laminar flow and furthering the negative lift component.

2. A surfboard according to claim 1 wherein said wing hydrofoils have radically backswept arcuate leading edges and have the greatest span dimension thereof adjacent to the trailing edges thereof.

3. A fin for fixed attachment to the tail of a surfboard, said fin comprising:

(a) a vertical hydrofoil having a downwardly-rearwardly swept leading edge as the fin is disposed on the underside surface of a surfboard in use and an arcuately forwardly relieved portion in the upper part only of the trailing edge portion of the vertical hydrofoil, the lower part of the trailing edge portion being forwardly-downwardly swept; and (b) wing hydrofoils integral with and extending only rearwardly from a mid-portion of and bilaterally of said vertical hydrofoil at the level of the bottom of said relieved portion and capable of generating an effective positive lift component for said tail when a surfer is taking off on a near static surfboard with said wing hydrofoils being forwardly-downwardly inclined relative to a horizontal portion of the surfboard to generate a negative hydrodynamic lift component during forward motion of the surfboard through the water.

4. A surfboard fin according to claim 3 wherein said wing hydrofoils are hydrodynamically shaped with the greatest effective span thereof adjacent to the trailing edges of the wing hydrofoils.

* * * * *